US005403515A

United States Patent [19]

Instone et al.

[11] Patent Number: 5,403,515

[45] Date of Patent: Apr. 4, 1995

[54] LIQUID CLEANING COMPOSITIONS COMPRISING PRIMARY ALKYL SULPHATE AND NON-IONIC SURFACTANTS

[75] Inventors: Terry Instone, South Wirral; David P. Jones, Chester; David Roscoe, Liverpool; Philip J. Sams, South Wirral; Martin Sharples, Wirral, all of United Kingdom

[73] Assignee: Lever Brothers Company, Division of Conopco, Inc., New York, N.Y.

[21] Appl. No.: 110,034

[22] Filed: Aug. 20, 1993

[30] Foreign Application Priority Data

Aug. 25, 1992 [GB] United Kingdom ..... 9218080
Nov. 5, 1992 [GB] United Kingdom ..... 9223236

[51] Int. Cl.[6] ..... C11D 1/12; C11D 1/755; C11D 3/16; C11D 1/83

[52] U.S. Cl. ..... 252/550; 252/174.21; 252/174.15; 252/559; 252/89.1; 252/173; 252/174.19; 252/DIG. 14

[58] Field of Search ..... 252/174.21, 174.15, 252/550, 559, DIG. 14, 89.1, 173

[56] References Cited

U.S. PATENT DOCUMENTS

| | | | |
|---|---|---|---|
| 4,110,262 | 8/1978 | Arnau et al. | 252/545 |
| 4,129,515 | 12/1978 | Foster | 252/117 |
| 4,133,779 | 1/1979 | Hellyer et al. | 252/547 |
| 4,435,317 | 3/1984 | Gerritsen et al. | 252/547 |
| 4,554,099 | 11/1985 | Llenado | 252/117 |
| 4,565,647 | 1/1986 | Llenado | 252/354 |
| 4,663,069 | 5/1987 | Clarke | 252/551 |

FOREIGN PATENT DOCUMENTS

| | | |
|---|---|---|
| 344847 | 3/1931 | European Pat. Off. . |
| 107946 | 10/1983 | European Pat. Off. . |
| 125771 | 4/1984 | European Pat. Off. . |
| 303187 | 8/1988 | European Pat. Off. . |
| 352244 | 6/1989 | European Pat. Off. . |
| 1273545 | 5/1972 | United Kingdom . |
| 1293613 | 10/1972 | United Kingdom . |
| 1524441 | 9/1978 | United Kingdom . |
| 1542696 | 3/1979 | United Kingdom . |
| 2144763 | 3/1985 | United Kingdom . |
| 2160887 | 1/1986 | United Kingdom . |
| 2160887 | 4/1986 | United Kingdom . |
| WO91/09929 | 7/1991 | WIPO . |

*Primary Examiner*—Allen J. Robinson
*Assistant Examiner*—Mary Cebulak
*Attorney, Agent, or Firm*—A. Kate Huffman

[57] ABSTRACT

The invention relates to surfactant containing, liquid compositions based on the magnesium salt of primary alcohol sulphates and provides and aqueous, liquid, cleaning composition having a pH from 6–8, comprising:

a) 2–40% wt surfactant, said surfactant comprising primary alcohol sulphate (i) and nonionic surfactants (ii) wherein at least 50% wt of the surfactant present is primary alcohol sulphate, said surfactant comprising less than 1% on surfactant of nitrogen-containing surfactant species b) magnesium, at a Molar ratio of at least 0.3 moles Mg per mole primary alcohol sulphate.

10 Claims, No Drawings

LIQUID CLEANING COMPOSITIONS COMPRISING PRIMARY ALKYL SULPHATE AND NON-IONIC SURFACTANTS

TECHNICAL FIELD

The present invention relates to surfactant containing, liquid compositions based on the magnesium salt of primary alcohol sulphates and non-ionic surfactants.

BACKGROUND OF THE INVENTION

General purpose household cleaning compositions (GPC's) for hard surfaces such as metal, glass, ceramic, plastic and linoleum surfaces are commercially available in both powdered and liquid form. Powdered cleaning compositions consist mainly of builder or buffering salts such as phosphates, carbonates, silicates etc. Such compositions display good inorganic soil removal, but they can be deficient in cleaning ability on organic soils such as the calcium and/or magnesium salts of fatty acids and fatty/greasy soils typically found in the domestic environment. Such compositions are generally buffered at an alkaline pH by the builder, and as it is generally believed that alkaline pH facilitates the detergency of free fatty acids by conversion into the corresponding soap.

Liquid cleaning compositions generally comprise an organic solvent and have the great advantage that they can be applied to hard surfaces in neat or concentrated form so that a relatively high level of surfactant material and organic solvent is directly delivered onto the soil. These liquid compositions are of utility in the cleaning of hard surfaces such as floors and walls and kitchen or bathroom surfaces as mentioned above and in cleaning soft furnishings such as upholstery, carpets, curtains etc.

Typically, the surfactants used in commercial general purpose cleaners include one or both of linear alkyl benzene sulphonates and secondary alkane sulphonates (SAS).

The incorporation of certain surfactants into such solvent/water compositions presents no difficulties when these surfactants are present at relatively low concentrations. European Patent EP 0344847 (P&G) discloses compositions comprising butoxy-propanol solvents in combination with up to 5% wt sodium linear C8–C18 alkyl benzene sulphonate.

Mixtures of linear alkyl benzene sulphonates with alcohol ethoxylates and optionally small amounts of fatty soaps comprise the surfactant system used in a number of successful, alkaline, commercial products.

A further outstanding technical problem with such compositions is that the surfactants most commonly used, are less biodegradable and consequently less preferable environmentally than other surfactant systems.

In particular, primary alcohol sulphate (hereinafter referred to as PAS) is an environmentally desirable anionic surfactant, both due to its ease of biodegradability as compared with linear alkyl benzene sulphonates and secondary alkane sulphonates and the fact that it can be derived from natural materials such as coconut and other vegetable oils as a source of fatty acid residues.

Primary alcohol sulphate comprises a mixture of materials of the general formulation:

$$RO—SO_3X$$

wherein R is a $C_8$ to $C_8$ primary alkyl group and X is a solubilising cation. Known counter ions include sodium, magnesium, potassium, ammonium, TEA and mixtures thereof.

GB 1524441 discloses formulations comprising 0–25% magnesium PAS, 0–6% of the magnesium salt of an ethoxylated PAS, dimethyl-dodecylamine oxide and triethanolamine.

EP 125711 (Clarke: 1984) relates to thick, opaque GPC's containing nonionic, anionic (examples are Mg-PAS) and a partially esterified resin.

GB-2160887 (Bristol Myers: 1984) relates to GPC's which comprise solvent, anionics including alkali metal, magnesium, ammonium and TEA-PAS salts and 0.005–3.0% of a nonionic including 75–100% on nonionic of a water insoluble nonionic. The sodium salt of the lauryl sulphate (Na-$C_{12}$ PAS) is the most preferred anionic surfactant.

GB 2144763 (P&G: 1983) relates to acidic cleaning composition in the form of a microemulsion, comprising at least 5% solvent and a magnesium salt. The preferred compositions comprise mixtures of nonionic surfactants, paraffin sulphonates, alkyl sulphates (PAS), ethoxylated phenols and ethoxylated alcohols.

EP 0107946 (P&G: 1982) relates to liquid detergent (dishwashing) compositions comprising 6–18% Mg-PAS, together with a water soluble $C_{13}$–$C_{18}$ alkane or alkene sulphonate and a water soluble alkyl ether sulphate.

Many of the compositions described in the above-mentioned documents comprise added electrolytes, which are believed to enhance cleaning. An outstanding technical problem which stems from the use of added electrolyte is the formation of residues on drying of the composition.

BRIEF DESCRIPTION OF THE INVENTION

We have determined that excellent fatty soil detergency can be obtained at neutral pH using a magnesium salt of PAS as the major surfactant component of a surfactant system which also comprises non-ionic surfactant in a cleaning composition without the requirements of added electrolytes or nitrogen based surfactants.

Detailed Description of the Invention

According to the present invention there is provided a neutral, aqueous, liquid, cleaning composition having a pH from 6–8, comprising:

a) 2–40% wt surfactant, said surfactant comprising primary alcohol sulphate (i) and nonionic surfactants (ii) wherein at least 50% wt of the surfactant present is primary alcohol sulphate, said surfactant comprising less than 1% on surfactant of nitrogen-containing surfactant species b) Magnesium, at a Molar ratio of at least 0.3 moles Mg per mole primary alcohol sulphate.

It is believed that neutral products are less damaging to the skin of the user than strongly acid or alkaline products.

Typically, compositions according to the present invention comprise no further added electrolytes particularly those selected from the group of alkali metal, alkaline earth and ammonium halides, phosphates, boreates, sulphates, carbonates and carboxylates (such as citrates). We have determined that with Mg PAS no such electrolyte is required in order to obtain acceptable cleaning performance.

It is believed that the choice of the magnesium salt of PAS as opposed to the sodium salt avoids the requirement for the presence of the abovementioned electrolytes in order to obtain excellent fatty soil detergency from hard surfaces. The absence of the added electrolytes, reduces the level of residue formation on drying of the composition.

Without wishing to limit the scope of the invention by reference to any theory of operation, it is believed that at normal ambient temperatures a micellar solution of PAS drying in a thin film on a hard surface behaves as if it were in direct equilibrium with solid PAS and consequently the material can pass rapidly from dilute solution into the solid phase without substantial residence in an intermediate liquid crystalline state. It is also believed that most other surfactants, particularly, alkyl benzene sulphates, alkyl ether sulphates, alkane sulphonates, alkyl amine oxides, alkyl betaines and amido betaines, dry into the solid state at ambient temperatures only after a substantial period in a liquid crystalline state. Commercially available, ethoxylated nonionic surfactants do not dry to a well-defined crystalline state, but remain at best as pasty solids. It is believed that the peculiar behaviour of PAS is responsible for the low residue levels which can be obtained with PAS as the solid residues which are formed are either dispersed as crystals which cannot readily be seen or easily removed by buffing.

In consequence of the above, it is believed that the use of MgPAS at high levels in compositions according to the present invention avoids perceptible residues of either the surfactant or arising from the electrolyte, while maintaining acceptable cleaning performance.

Surfactants

Typical compositions according to the present invention comprise 20–40% surfactant, preferably around 27–33% surfactant.

Particularly preferred compositions comprise 15–30% primary alkyl sulphate and 5–15% non-ionic surfactant. The preferred ratio of the PAS to the nonionic is in the range 3:1 to 1:1 and is preferably around 2:1, i.e. 1.5–2.5:1. These relatively high levels of PAS and non-ionic surfactant are desirable in order to form concentrated compositions which can be transported more efficiently and require less packaging material.

The preferred primary alcohol sulphate comprises a mixture of materials of the general formulation:

$$(RO—So_3)_2Mg$$

wherein R is a $C_{10}$ to $C_{18}$, more preferably $C_{12}$ to $C_{14}$ primary alkyl group.

The preferred nonionic surfactant is selected from the group comprising ethoxylated alcohols of the general formula:

$$R_1—(OCH_2CH_2)_m—OH$$

wherein $R_1$ is straight or branched, $C_8$ to $C_{18}$ alkyl, preferably $C_8$–$C_{14}$, most preferably $C_8$–$C_{12}$ and the average degree of ethoxylation m is 1–14, preferably 3–10. The narrower range of ethoxylation is preferred due to the fatty soil detergency performance of this sub-class of ethoxylates. The starting materials for the synthesis of these ethoxylated alcohols, a minor component of the surfactant system, are available from both natural and synthetic sources.

Preferably, no other surfactants than PAS and ethoxylated non-ionic surfactants are present.

Solvent

In typical formulations according to the present invention the composition further comprises a solvent other than water.

Preferably, the solvent is selected from: propylene glycol mono n-butyl ether, dipropylene glycol mono n-butyl ether, propylene glycol mono t-butyl ether, dipropylene glycol mono t-butyl ether, diethylene glycol hexyl ether, ethyl acetate, methanol, ethanol, isopropyl alcohol, ethylene glycol monobutyl ether, diethylene glycol monobutyl ether and mixtures thereof.

Particularly preferred solvents are selected from the group comprising ethanol (preferably as industrial methylated spirits), propylene glycol mono n-butyl ether (available as 'Dowanol PnB' [RTM]) and di-ethylene glycol monobutyl ether (available as 'Butyl Digol' [RTM]or 'Butyl Carbitol' [RTM]). These solvents are preferred due to cost, availability and safety factors. We have determined that this selection of solvents gives enhanced cleaning performance as regards inks and dyestuffs and improved product stability.

Preferred ranges for the total surfactant:solvent ratios fall in the range 1:1 to 10:1, preferably 2:1 to 5:1. The narrower ratio range is preferred for reasons of cost and product stability. Typical solvent contents are 1–30% wt of the composition, preferably 5–20% of the composition, in order to achieve an effective solvent concentration on dilution of the concentrates.

The compositions of the invention can further comprise other components selected from the group comprising: perfumes, colours and dyes, hygiene agents, foam-control agents, viscosity modifying agents and mixtures thereof.

Preferably the foam control agents comprise calcium sensitive soaps in combination with hydrocarbons or terpienes.

Typically compositions according to the present invention are isotropic. An advantage of isotropic compositions, in which the anti-foaming oil is initially solubilised is that they need not be shaken vigorously before use.

Generally, compositions according to the present invention are transparent. In particular the presence of abrasives and other materials which would give rise to residues should be avoided.

As mentioned above, compositions according to the present invention can contain a hydrophobic oil in combination with a calcium sensitive soap as a foam control system.

Preferably, the hydrophobic oil is a linear or branched chain hydrocarbon or silicone oil. More preferably the hydrophobic oil is a paraffin.

Most preferably, the hydrophobic oil is a paraffin with a 50% wt loss boiling point in the range 170–300, Celsius. The term 50% loss boiling point being intended to indicate that 50% of the weight of the paraffin can be distilled off at a temperature within this range. In general the limits of boiling points of paraffin suitable for use in the composition of the present invention lie between 171 and 250 Celsius. We have found that the isoparaffins, i.e. branched chain paraffins, are particularly effective when compared with other hydrophobic oils such as n-decane and n-tetradecane.

The solubilised hydrophobic oil content of embodiments of the present invention is typically in the range 0.2–5wt %, preferably 1.0–2.0wt %.

The insoluble calcium salt-forming surfactant content of embodiments of the invention is 0.2–5% wt: the upper levels of this range being used for more highly concentrated compositions. Preferably the insoluble calcium salt-forming surfactant content is in the range 1.0–2.0% wt. Surfactants which form insoluble calcium salts include fatty acids, soluble salts of fatty acids (traditional 'soaps') with a suitable cation, preferably derived from fatty acids having an average carbon chain length in the range 8–24. Alternative surfactants include surfactant sulphates and sulphonates: in general, anionic surfactants of which the calcium salt has a Krafft temperature above product use temperature.

The preferred ratio of insoluble calcium salt forming surfactant to hydrophobic oil is in the range 0.5–1:1–0.5, preferably about 1:1. These proportions form a particularly effective antifoam system.

Specific embodiments of the present invention preferably comprise:

a) 2–40% wt surfactant, said surfactant comprising primary alcohol sulphate (i) and optionally one or more nonionic surfactant (ii) wherein at least 50% wt of the surfactant present is primary alcohol sulphate, b) Magnesium, at a Molar ratio of 0.3–0.8 moles Mg per mole primary alcohol sulphate, c) At least one solvent selected from the group of glycol ether and 1–5 carbon alcohol solvents, in an amount such that the surfactant:solvent ratios fall in the range 1:1 to 10:1, and, said composition being essentially free of added electrolytes selected from the group of alkali metal, alkaline earth and ammonium halides, sulphates, carbonates and carboxylates.

EXAMPLES

The following formulation was prepared by mixing of the components as listed in table 1. The components were obtained as follows:

Isoparaffin: ISOPAR-L (RTM, ex Exxon), a branched hydrocarbon with a boiling point range of 190–207 Celsius;

Magnesium PAS: EMPICOL ML26/F (RTM ex Albright & Wilson), a magnesium salt of primary alcohol sulphate having an average alkyl chain length in the range $C_{12}$–$C_{14}$;

Nonionic A: BIODAC L5-S52 (RTM: ex DAC); ethoxylated alcohol;

Nonionic B: IMBENTIN 91-35 OFA (RTM: ex Kolb); ethoxylated alcohol;

Solvent: Butyl Carbitol (RTM: ex Union Carbide); glycol ether;

Fatty Acid: Prifac 7904 (RTM ex Unichema) based on coconut fatty acids;

Minor components comprised preservatives and perfume. All compositions were made up to 100% with water.

EXAMPLES 1–8:

TABLE 1

| Example | 1 | 2 | 3 | 4 | 5 | 6 | 7 | 8 |
|---|---|---|---|---|---|---|---|---|
| Magnesium PAS | 18.5 | — | 22.5 | — | — | — | — | 7.5 |
| Sodium PAS | — | 18.5 | — | 22.5 | 7.5 | 7.5 | 7.5 | — |
| Nonionic A | 9.5 | 9.5 | 7.5 | 7.5 | — | — | — | — |
| Sodium Carbonate | — | — | — | 3.0 | — | — | — | — |
| Sodium Chloride | — | — | — | — | — | 2.0 | 5.0 | — |
| Solvent | 8.0 | 8.0 | — | — | — | — | — | — |
| Ethanol | — | — | 10 | 10 | — | — | — | — |
| Fatty Acid | 1.4 | 1.4 | 2.0 | 2.0 | — | — | — | — |
| Isoparaffin | 1.5 | 1.5 | — | — | — | — | — | — |
| Minors | tr. | tr. | tr. | tr. | — | — | — | — |
| pH | 6–8 | 6–8 | 6–8 | 11 | 6–8 | 6–8 | 6–8 | 6–8 |
| Total Effort | 2.2 | 2.0 | 2.1 | 2.9 | >10 | 5.3 | 4.8 | 4.9 |
| Residues | 1 | 2 | 1 | 3 | 2 | 3 | 3 | 1 |

Examples 1 and 3 are examples of the present invention, example 2 and 4–7 are comparative examples. Table 1 lists the total cleaning effort score for the compositions of examples 1–8 under 'total effort'. The figures given represent the total cleaning effort required to remove a fatty soil from a surface to a visibly clean limit, represented on a ten point scale of 1 (little effort required) to 10 (high effort required). It can be seen that the compositions of examples 1 and 8 perform well without the requirement of added electrolyte. Examples 2, 5 and 6 perform worse.

Table 1 also lists the residue score of the compositions. This score is based on a subjective assessment of residues following the application of a solution of the compositions diluted such that it contains 1% wt total surfactant. The solutions were applied to a black ceramic tile and allowed to evaporate to dryness. Scores were given on a six point scale of 0 (no residue) to 5 (high residues).

From the results it can be seen that examples 2 and 4–7 either show poor residue performance or require a high cleaning effort, whereas the compositions according to the present invention generally exhibit low effort cleaning and good residue performance.

EXAMPLES 8–16:

Table 2, below, shows performance of compositions according to the present invention against compositions comprising non-ionic as sole surfactant, to demonstrate the reside effects more clearly. These Mg PAS only compositions could not be prepared at higher Mg PAS levels as such formulations are unstable, particularly at low temperatures, in the absence of low levels of non-ionic surfactant.

TABLE 2

| Example | 8 | 9 | 10 | 11 | 12 | 13 | 14 | 15 | 16 |
|---|---|---|---|---|---|---|---|---|---|
| Magnesium PAS | 7.5 | — | — | — | — | — | — | 18.5 | 22.5 |
| Nonionic B | — | 7.5 | 7.5 | 7.5 | 28 | 28 | 28 | — | — |
| Nonionic A | — | — | — | — | — | — | — | 9.5 | 7.5 |
| Sodium Sulphate | — | — | 1 | 2.0 | — | — | 1 | — | — |
| Solvent | — | — | — | — | — | 8 | 8 | 8 | — |
| Ethanol | — | — | — | — | — | — | — | — | 10 |
| Minors | tr. | tr. | tr. | tr. | tr. | tr. | tr. | tr. | tr. |
| pH | 6–8 | 6–8 | 6–8 | 6–8 | 6–8 | 6–8 | 6–8 | 6–8 | 6–8 |

TABLE 2-continued

| Example | 8 | 9 | 10 | 11 | 12 | 13 | 14 | 15 | 16 |
|---|---|---|---|---|---|---|---|---|---|
| Residues | 1 | 3 | 3 | 3 | 3 | 3 | 4 | 1 | 1 |

From the above it can be seen that the embodiment of the invention (15 and 16) and a MgPAS-only system (8) performed well in terms of residues, while the other systems did not perform as well. In examples 15 and 16 it will be noted that some nonionic is present: compositions of around 20% MgPAS which were free of nonionic were unstable, particularly at low temperatures.

EXAMPLE 17

The formulation of example 1 was compared with a commercially available product ('AJAX: CITRON VERT (RTM)') which is well known to comprise secondary alkane sulphonate and ethoxylated alcohol at a level of around 7.5%, in the presence of magnesium added in the form of the sulphate and a 'co-surfactant' glycol ether solvent. For the admittedly non-concentrated commercial product, an effort score of >10 and a residue score of 3 was obtained in the tests described above, except that the soil loading was doubled. The formulation of example 1, produced an effort score of 4.5 and, despite the presence of much higher surfactant levels only produced a residue score of 1.

EXAMPLES 18–19

Formulations were prepared according to EP 0107946 and GB 1524441 as being representative of surfactant systems comprising at least one nitrogen-containing surfactant in addition to Mg PAS. Despite the absence of the nitrogen-containing surfactant from the compositions of the present invention, no reduction in performance as compared with the prior compositions was observed.

We claim:

1. An aqueous cleaning composition comprising:
   a. 15–30 wt. % of a primary alcohol sulphate;
   b. 5–15 wt. % of a nonionic surfactant; and
   c. magnesium, a molar ratio of at least 0.3 moles Mg per mole of the primary alcohol sulphate, the sulphate comprising less than 1% of the surfactant of nitrogen-containing surfactant species and the composition having a pH from 6 to 8 and being essentially free of added electrolytes selected from the group of alkali metal, alkaline earth, ammonium halide, sulphate, carbonate, carboxylates and mixtures thereof.

2. An aqueous liquid cleaning composition comprising:
   a. 15–30 wt. % of a primary alcohol sulphate;
   b. 5–15 wt. % of a nonionic surfactant; and
   c. magnesium, a molar ratio of at least 0.3 moles Mg per mole of the primary alcohol sulphate, the sulphate comprising less than 1% of the surfactant of nitrogen-containing surfactant species and
   d. 1–10 wt. % of a water-soluble organic acid selected from the group consisting of citric acid, adipic acid, succinic acid, glutaric acid, salts of the acids thereof, and mixtures thereof;
   e. at least one solvent selected from the group of glycol ether and 1–5 carbon alcohol solvent in an amount such that the surfactant-to-solvent ratio falls in the range 1:1 to 10:1; and
   f. 0.2–5 wt. % $C_{10-18}$ fatty acid, the composition having a pH of 6 to 8 and being essentially free of added electrolytes selected from the group of alkali metal, alkaline earth, ammonium halide, sulphate, carbonate, carboxylates and mixtures thereof.

3. Composition according to claim 1 wherein the ratio of the PAS to the non-ionic is in the range 3:1 to 1:1.

4. Composition according to claim 1 further comprising a solvent other than water.

5. Composition according to claim 1 wherein the surfactant: solvent ratios fall in the range 1:1 to 10:1.

6. Composition according to claim 1 comprising C10–18 fatty acids.

7. Composition according to claim 1 comprising a sequestrant for metals.

8. Composition according to claim 7 wherein the sequestrant is selected from polycarboxylic acids, polyacrylates, phosphonates and salts thereof.

9. Composition according to claim 7 wherein the sequestrant is citric acid or salts thereof.

10. Composition according to claim 1 further comprising a hydrophobic oil.

* * * * *